US005328162A

United States Patent [19]

Oishi

[11] Patent Number: 5,328,162

[45] Date of Patent: Jul. 12, 1994

[54] COLLATOR WITH MULTIPLE ROWS OF FEEDERS

[75] Inventor: Koji Oishi, Kyoto, Japan

[73] Assignee: Horizon International Inc., Shiga, Japan

[21] Appl. No.: 971,047

[22] Filed: Nov. 3, 1992

[30] Foreign Application Priority Data

Nov. 5, 1991 [JP] Japan ..... 3-350560

[51] Int. Cl.[5] ..... B65H 39/04

[52] U.S. Cl. ..... 270/58

[58] Field of Search ..... 270/58

[56] References Cited

U.S. PATENT DOCUMENTS 3,216,719 11/1965 Flora .
3,825,247 7/1974 Fernandez-Rana et al. .
3,951,399 4/1976 Reist ..... 270/58
4,511,132 4/1985 Muller ..... 270/58
4,588,179 5/1986 Gutierrez ..... 270/58
4,684,117 8/1987 Honegger et al. ..... 270/58 X

FOREIGN PATENT DOCUMENTS 510525 10/1992 European Pat. Off. ..... 270/58
813948 6/1937 France .
209164 12/1982 Japan .
654442 6/1951 United Kingdom .
901816 7/1962 United Kingdom .

*Primary Examiner*—Edward K. Look
*Assistant Examiner*—John Ryzmic
*Attorney, Agent, or Firm*—Morgan & Finnegan

[57] ABSTRACT

A plurality of rows of sheet loading stations for receiving a supply of sheets to be collated are spaced in parallel with one another. A sheet receiving and transfering line having a plurality of sheet receiving stations aligned for receiving sheets from the sheet loading stations is arranged. Sheet feeding mechanism is provided for repeatedly feeding sheets all together from each row of sheet loading stations to the sheet receiving stations. A mechanism for transferring sheets received at sheet receiving stations to the respective next sheet receiving stations on the sheet receiving and transfering line in order to receive sheets fed from another row of sheet loading stations according to a predetermined collation sequence. Even in case a number of pages should be collated, the reduction of the horizontal dimension of the collator is achieved so as to economize space for instaling the collator.

4 Claims, 7 Drawing Sheets

COLLATOR WITH MULTIPLE ROWS OF FEEDERS

BACKGROUND OF THE INVENTION

This invention relates to a collator, particularly to a horizontal type collator.

As is known in the art, the horizontal type collator is often employed in order to collate relatively thick section consisting of, for example 16-pages or 8-pages. In the horizontal type collator, a plurality of sheet stacks to be collated are transversely aligned in a collation sequence and a plurality of sheet receiving sections are transversely arranged in the collation sequence for receiving sheets from the sheet stacks. And a sheet feeding mechanism is provided for each sheet feeding mechanism. Then every sheet feeding mechanism is simultaneously driven so that sheets are fed at the same time from every sheet stack to the sheet receiving sections. Such sheet feeding operation of the sheet feeding mechanisms is repeatedly performed. Furthermore, the sheets received at the sheet receiving sections are transported to the respective next higher order sheet receiving sections synchronously with the sheet feeding operation. Thus the complete set of sheets can be collated at the highest order sheet receiving section.

However, the more the number of the page becomes, the longer the collator becomes in the transverse direction, so that a larger space is required for instaling the collator.

SUMMARY OF THE INVENTION

It is the object of the present invention to achieve the reduction of the transverse dimension of the collator so as to economize space for instaling the collator.

According to the present invention there is provided a collator which comprises a plurality of rows of sheet loading stations for receiving a supply of sheets to be collated, said plurality of rows of sheet loading stations being arranged in parallel with one another; a sheet receiving and transferring line having a plurality of sheet receiving stations aligned for receiving sheets from said sheet loading stations; sheet feeding means provided for repeatedly feeding sheets all together from said each row of sheet loading stations to said plurality of sheet receiving stations on said sheet receiving and transferring line; means for transferring sheets received at said sheet receiving stations on said sheet receiving and transferring line to the respective next sheet receiving stations on said sheet receiving and transferring line in order to receive sheets fed from another row of sheet loading stations according to a predetermined collation sequence.

In accordance with a preferred embodiment, said collator further comprises means for operatively interconnecting the sheet feeding operation of said sheet feeding means with the sheet transferring operation of said means for transferring sheets received at said sheet receiving stations on said sheet receiving and transferring line to the respective next sheet receiving stations on said sheet receiving and transferring line.

In accordance with another preferred embodiment, said sheet receiving and transferring line is arranged in parallel with said each row of sheet loading stations and said sheet feeding means comprises: a pair of shafts, one of which is disposed under the outermost row of sheet loading stations in parallel therewith, the other of which is disposed immediately in front of said sheet receiving and transferring line in parallel therewith, said each shaft being provided with a first chain wheel at its ends; a pair of first endless chains extending between said pair of shafts through said first chain wheels; a motor for driving one of said shaft pair through a drive belt; a plurality of connecting members extending between said pair of first endless chains, said plurality of connecting members being arranged at appropriate spaces; a plurality of clip means connected to said each connecting member for picking out sheets all together from the corresponding row of sheet loading stations so as to deliver the sheets to said sheet receiving stations on said sheet receiving and transferring line; sheet delivering means arranged for said each sheet loading station, said sheet delivering means being provided for delivering sheets one by one from said sheet loading station to said clip means.

In accordance with still another preferred embodiment, said each clip means comprises: a fixed portion supported by said connecting member; a movable portion pivotably supported on a shaft fixed to said connecting member, said movable portion being provided with a cam follower; a spring for urging the tip of said movable portion toward said fixed portion; a cam provided with a cam groove, said cam follower of said movable portion being guided within said cam groove, whereby said movable portion is movable between an open position whereat its tip is away from said fixed portion against the urging force of said spring and a closed position whereat its tip is pushed toward said fixed portion by the urging force of said spring during drive of said pair of first endless chains.

In accordance with still another preferred embodiment, said plurality of sheet receiving stations are continuously arranged on said sheet receiving and transferring line and said means for transferring sheets received at said sheet receiving stations on said sheet receiving and transferring line to the respective next sheet receiving stations on said sheet receiving and line comprises: a pair of second chain wheels each disposed at the both ends of said sheet receiving and transferring line, respectively; a second endless chain extending between said pair of second chain wheels, said second endless chain being arranged in parallel with said sheet receiving and transferring line; a plurality of arms attached to said second endless chain at predetermined spaces, each of said plurality of arms projecting toward said sheet receiving and transferring line so as to move sheets received at sheet receiving stations on said sheet receiving and transferring line to the respective next sheet receiving stations on said sheet receiving and transferring line with drive of said second endless chain.

In accordance with still another preferred embodiment, said means for operatively interconnecting the sheet feeding operation of said sheet feeding means with the sheet transferring operation of said means for transferring sheets received at said sheet receiving stations on said sheet receiving and transferring line to the respective next sheet receiving stations on said sheet receiving and transferring line comprises a set of bevel gears for transmitting the rotation of said first chain wheel driving said first endless chains to one of said second chain wheels of said second endless chain.

According to the present invention there is provided a method of sheet collation comprises the steps of: providing a plurality of rows of sheet loading stations for receiving a supply of sheets to be collated, said plurality of rows of sheet loading stations being arranged in parallel with one another; feeding sheets all together from each of said rows of sheet loading stations to a sheet receiving and transferring line having a plurality of sheet receiving stations so as to receive said sheets at said sheet receiving stations, respectively; transferring sheets fed to said sheet receiving stations on said sheet receiving and transferring line to the respective next sheet receiving stations on said sheet receiving and transferring line in order to receive sheets fed from another row of sheet loading stations according to a predetermined collation sequence.

In accordance with a preferred embodiment, said method of sheet collation further comprises the step of operatively interconnecting the sheet feeding operation with the sheet transferring operation.

If there is provided M rows of sheet loading stations and each row consists of N sheet loading stations, $N \times M$ pages can be collated. However, in this case, the transverse dimension of the collator corresponds to no more than the length of one row of sheet loading stations. Consequently even in case a number of pages should be collated, the reduction of the transverse dimension of the collator is achieved so as to economize space for instaling the collator.

BRIEF DESCRIPTION OF THE DRAWINGS

The other objects and features of this invention will become understood from the following description with reference to the accompanying drawings wherein.

DETAILED DESCRIPTION OF THE PREFERRED EMBODIMENTS

Figure 1:
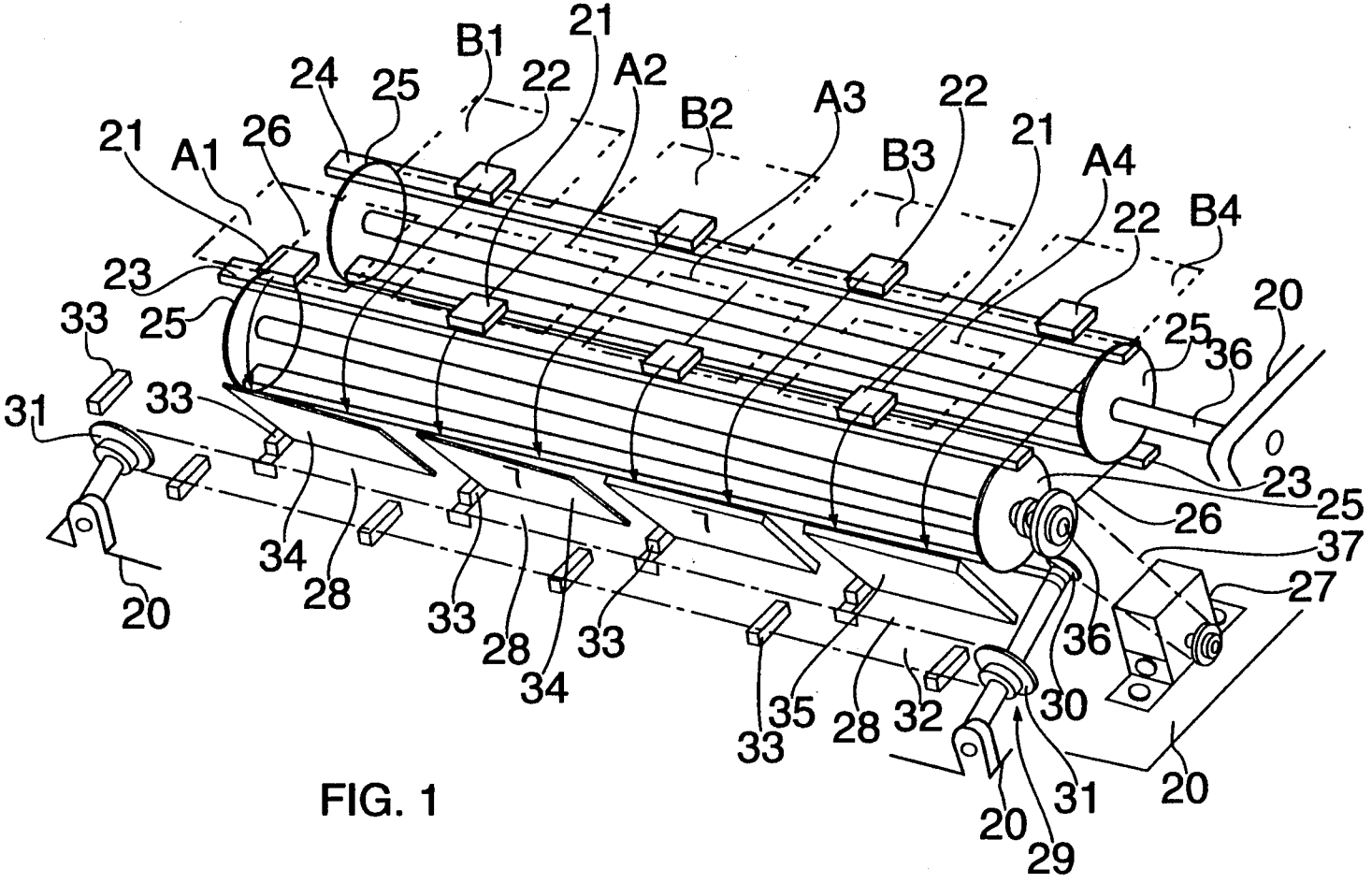
FIG. 1 is a perspective view of one embodiment of a collator in accordance with the present invention.
Figure 2:
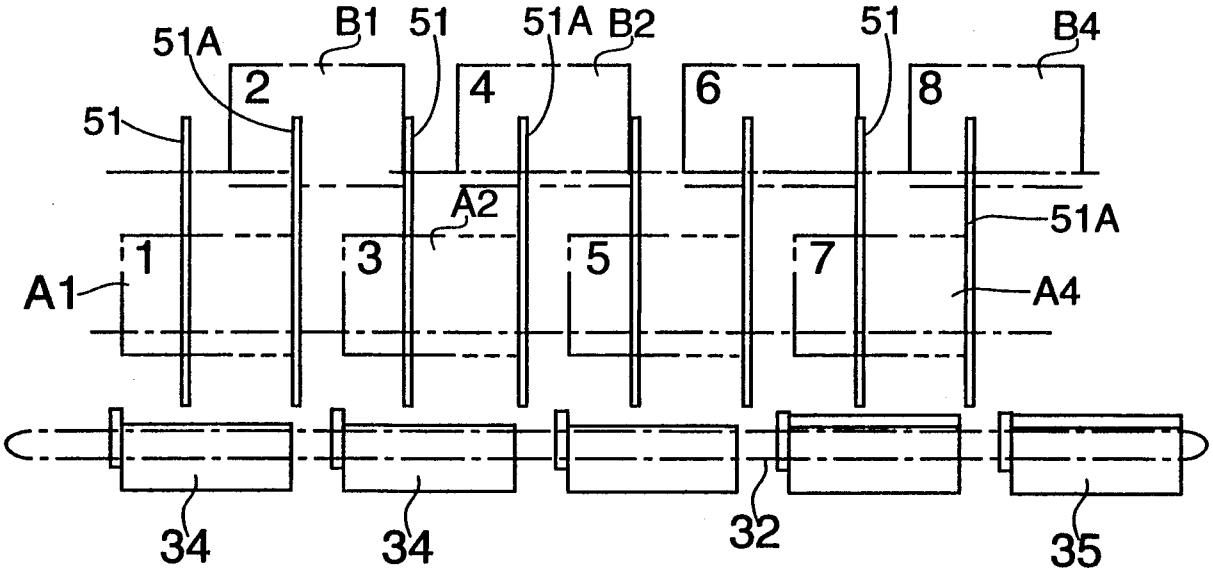
FIG. 2 is a plan view showing an arrangement of sheet loading shelves in the collator shown in FIG. 1.

FIG. 1 and FIG. 2 illustrate an embodiment of a collator in accordance with the present invention. In FIGS. 1 and 2, two rows of sheet loading stations for receiving a supply of sheets to be collated are parallely arranged at appropriate spacing and the respective rows consist of four sheet loading stations transversely aligned at regular spaces. The symbols (A1)–(A4) designate the sheet loading stations composing a first row, respectively and the symbols (B1)–(B4) designate the sheet loading stations composing a second row, respectively. The respective sheet loading stations (A1)–(A4) of the first row and the respective sheet loading stations (B1)–(B4) of the second row are alternately arranged in the transverse direction. And these sheet loading stations are arranged in such a manner that sheets are collated in the collation order (A1)–(B1)-(A2)–(B2)- . . . -(A4)–(B4). In FIG. 2, the number assigned to each sheet loading station corresponds to the collation sequence.

Figure 4:
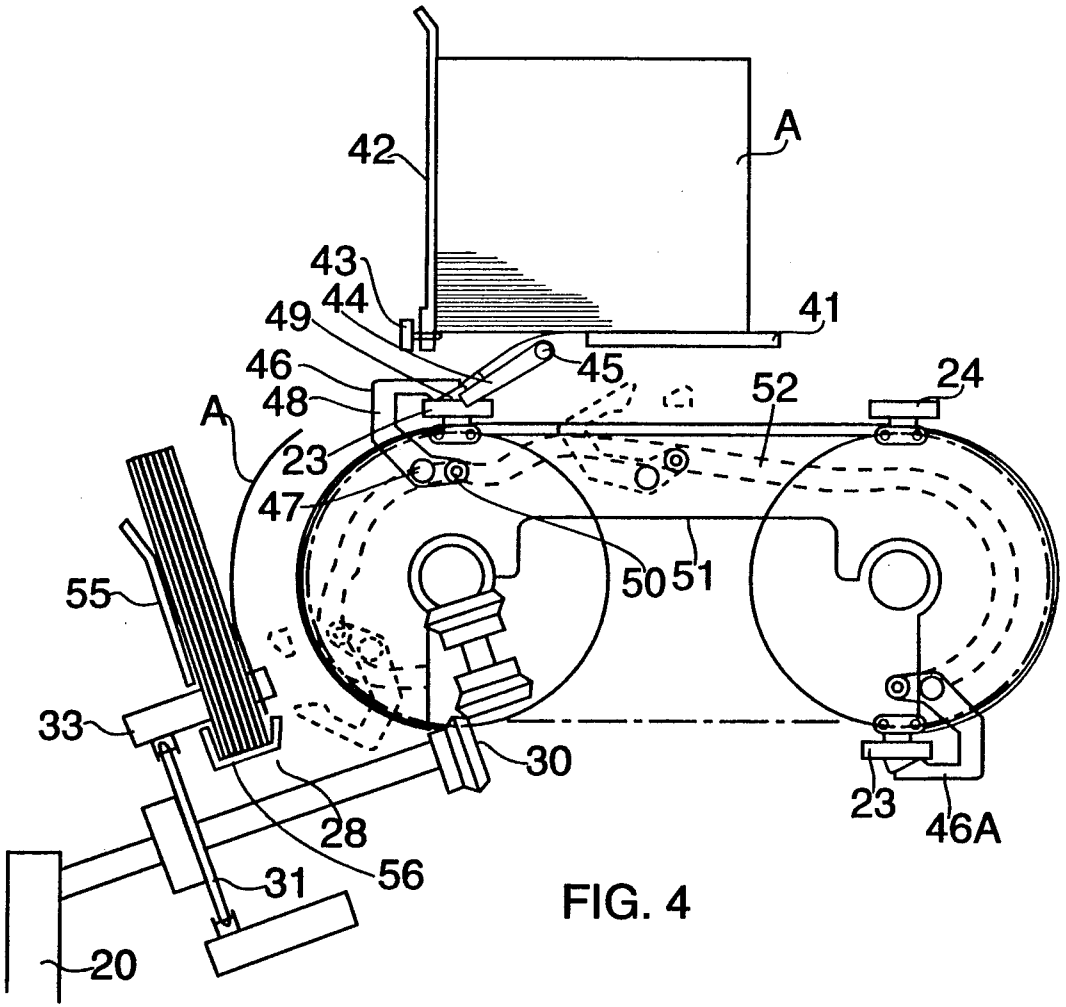
FIG. 4 is a side view of a first clip mechanism of the collator shown in FIG. 1.

As shown in FIG. 4, each of the sheet loading stations are provided with a front plate (42) attached to a machine frame for serving as a stopper to define the front ends of sheets of a paper sheet stack (A) and a sheet supporting plate (41) with the stack (A) horizontally attached to the machine frame. The sheet supporting plate (41) is disposed perpendicular to the surface of the front plate (42) at a certain distance from the front end of the sheet supporting plate (41). Furthermore, the front end portion of the lower surface of the stack (A) is supported on a receiving screw (43) attached to the front plate (42).

Referring to FIG. 1, a sheet receiving and transferring line (28) is arranged in parallel with the rows of sheet loading stations for receiving sheets from the sheet loading stations. As shown in FIG. 4, the sheet receiving and transferring line (28) comprises a base plate (56) inclined downward to the rear and a guide plate (55) disposed perpendicular to the base plate (56) at a certain distance from the upper surface of the base plate (56). As shown in FIG. 2, there are provided a plurality of sheet receiving stations aligned on the sheet receiving and transferring line (28), for example, in this embodiment, there are eight sheet collating stations in all. In this embodiment, adjacent sheet receiving stations are partially overlapped with each other.

Figure 5:
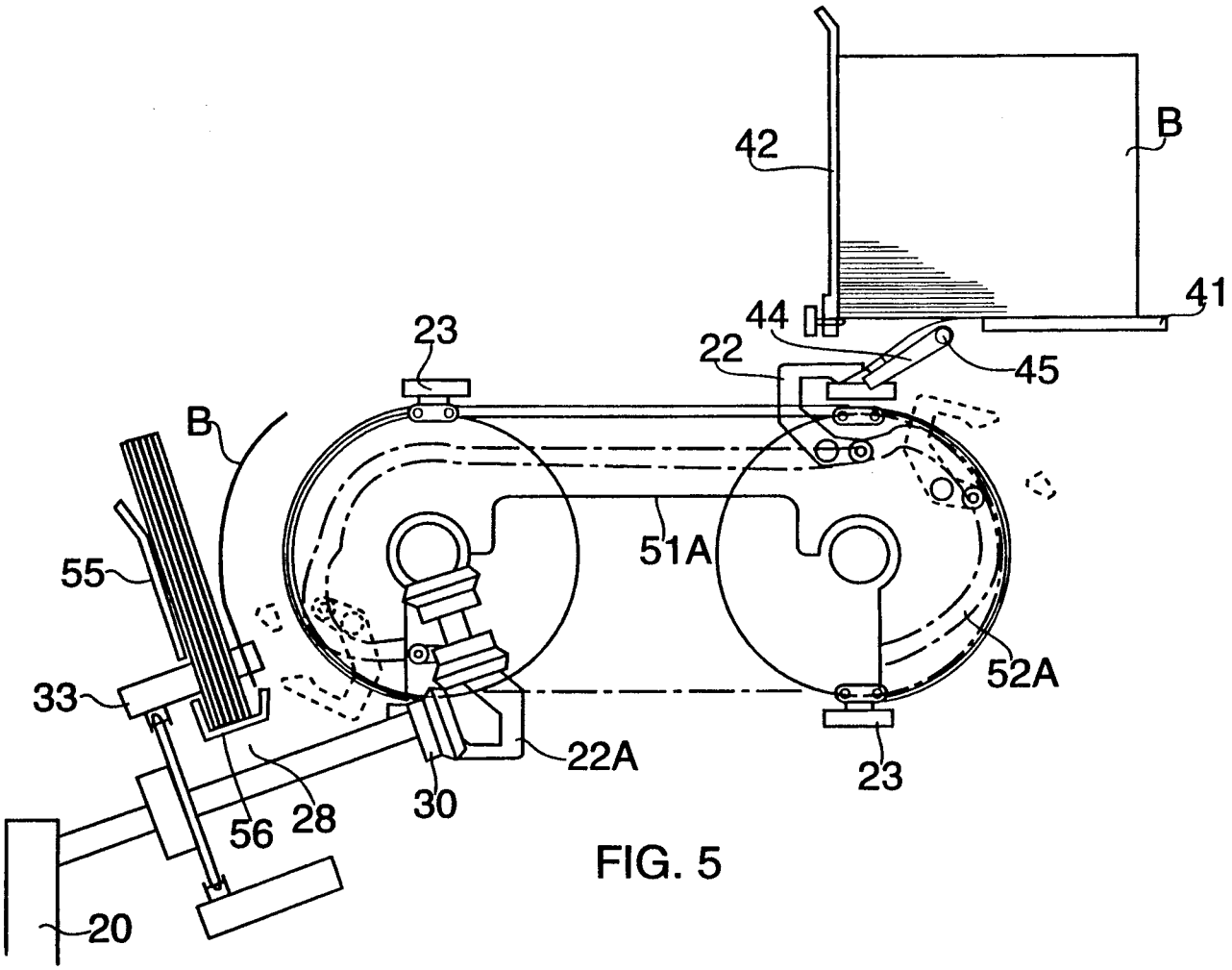
FIG. 5 is a side view of a second clip mechanism of the collator shown in FIG. 1.

A sheet feeding mechanism is provided for repeatedly feeding sheets all together from each row of sheet loading stations. Referring to FIGS. 1, 4 and 5, the sheet feeding mechanism includes a pair of shafts (36) one of which is disposed under the second row of sheet loading stations in parallel therewith, the other of which is disposed immediately before the sheet receiving and transferring line (28) in parallel therewith, each of the shaft (36) being provided with a first chain wheel (25) at its ends, a pair of first endless chains (26), (26) extending between that pair of shafts (36) through the first chain wheels (25) and a motor (27) for driving one of the shaft through a drive belt (37). Thus the pair of first endless chains (25) are driven between the second row of sheet loading stations and the sheet receiving and transferring line (28). Furthermore, two first connecting members (23) and two second connecting members (24) extend between the chain pair (26), respectively. The first and second connecting members (23), (24) are arranged alternately at appropriate spaces. Then a plurality of first clip mechanisms (21) are connected to the respective first connecting members (23) and a plurality of second clip mechanisms (22) are connected to the respective second connecting members (24).

Each first clip mechanism (21) is associated with a sheet loading stations of the first row and each second clip mechanism (22) is associated with the sheet loading stations of the second row.

There is provided two first connecting members (23) and two second connecting members (24) in the embodiment shown in FIG. 1 because it is intended that during a single revolution of the first chain pair (26), hence, a double revolution of the chain wheel pair (25), sheets are fed twice from each row of sheet loading stations.

When the pair of first endless chains (26) are driven by the chain wheels (25), the first and second connecting members (23), (24) are moved, respectively, which leads to the same movement of the clip mechanisms connected to the same connecting members. At the beginning sheets are fed by the first clip mechanisms (21) all together from the first row of sheet loading stations to the sheet receiving stations on the sheet receiving and transferring line (28) and successively fed by the sheet feeding mechanisms (22) all together from the second row of sheet loading stations to the sheet receiving stations on the sheet receiving and transferring line (28).

Figure 6:
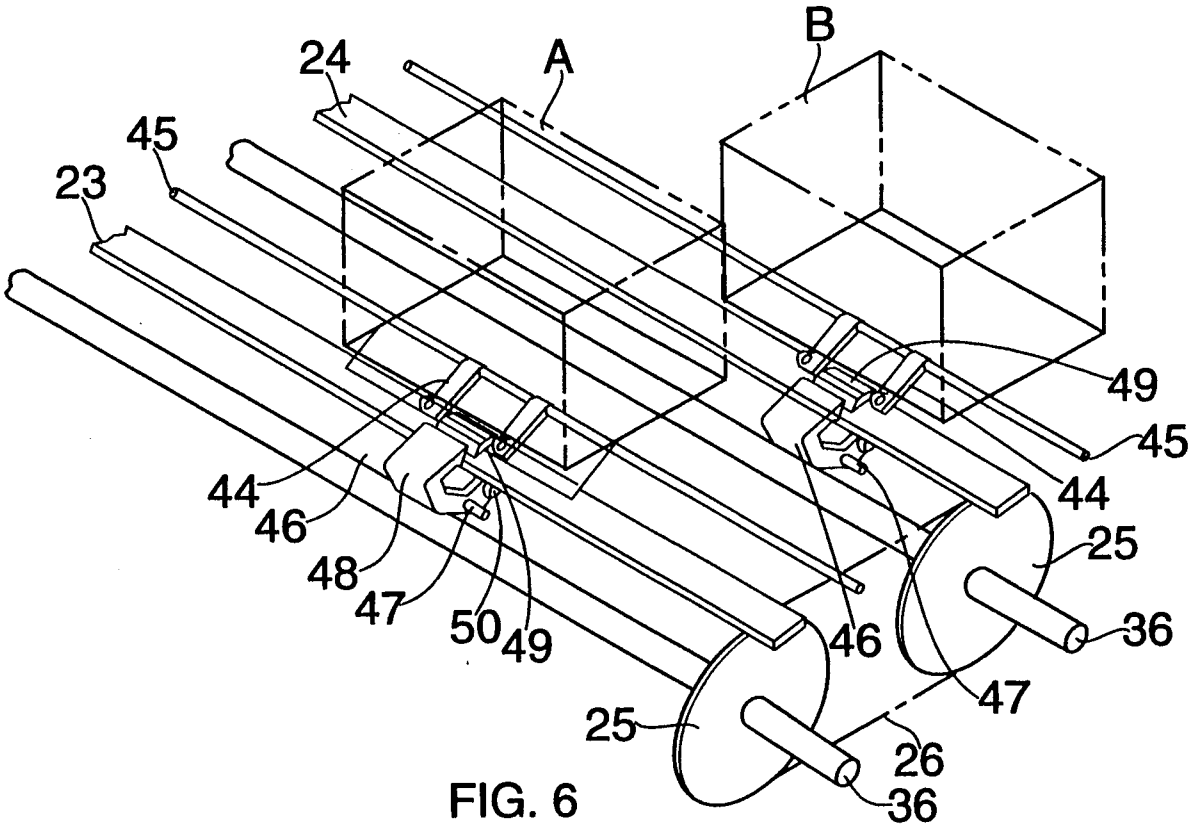
FIG. 6 is a perspective view of the clip mechanisms shown in FIGS. 4 and 5.

The first clip mechanism (21) and the second clip mechanism (22) are shown in detail in FIG. 4 and FIG. 5, respectively. And FIG. 6 is a perspective view of the clip mechanism shown in FIGS. 4 and 5.

As shown in FIGS. 4 and 5, each sheet loading station is provided with a sucker (44) for delivering sheets one by one from the sheet loading station to the associated clip mechanism. In FIG. 4, the sucker (44) is disposed between the sheet supporting plate (41) and the front plate (42) for swing about a shaft (45) fixed to the machine frame. The sucker (44) is movable between a first position in which it is engageable with the lowermost sheet of the stack (A) and a second position in which it is retracted below from the bottom surface of the stack to draw out the lowermost sheet. When air is blown from an air pipe (not shown) located forwardly of the front plate (42) to separate from the lowermost sheet of the stack from the stack, the sucker (44) rotates clockwise to the first position so as to suck it. After the suction, the sucker (44) moves counterclockwise to the second position shown in FIG. 4 to deliver the sheet to the first clip mechanism (21).

The clip mechanism (46) includes a movable portion (48) pivotably supported on a shaft (47) fixed to the connecting member (23) and a fixed portion (49) supported by the connecting member (23). The tip of the movable portion (48) is pushed toward the fixed portion (49) through the urging force of a spring (not shown). The movable portion (48) is provided with a cam follower (50) which is guided within a cam groove (52) of a cam (51) fixed to the machine frame. Thus the movable portion (48) is movable between an open position whereat its tip is away from the fixed portion (49) against the urging force of the spring and a closed position whereat its tip is pushed toward the fixed portion (49) by the urging force of the spring in order to clip a sheet between the movable and fixed portions during drive of the pair of first endless chains (26).

Figure 7:
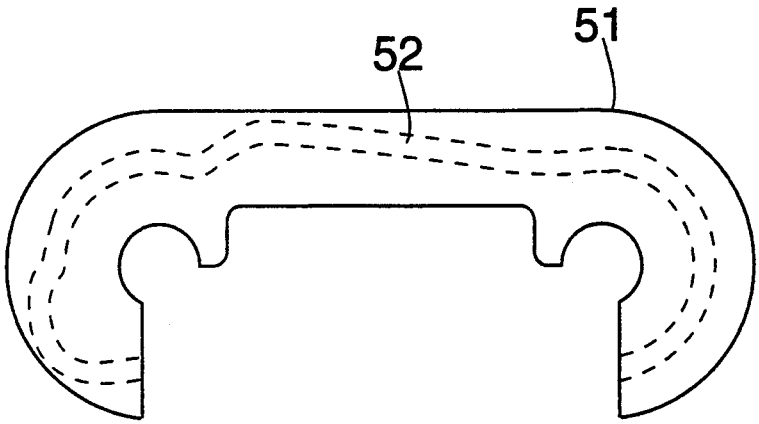
FIG. 7 is a plan view of a cam employed in the first clip mechanism shown in FIG. 4.

FIG. 7 shows the cam (51) and the cam groove (52). In FIG. 6, for explicity, the cam follower (50) is shown in the same side as the shaft (47), but the cam follower (50) is actually positioned at the opposite side.

At the second position of the sucker (44), the sheet is delivered from the sucker (44) to the clip mechanism (46). Then the clip mechanism (46) is moved by the drive of the first chain pairs (26) toward the sheet receiving and transferring line (28) with the sheet clipped thereby.

Then the clip mechanism (46) reaches the sheet receiving and transferring line (28), where the sheet clipped by the clip mechanism (46) is put on the base plate (56) of the sheet receiving and transferring line (28) with the help of the guide plate (55). At this moment, the movable portion (48) is rotated to the open position shown by a broken line in FIG. 4, so that the sheet (A) is released from the clipment by the clip mechanism (46) to fall on the base plate (56).

Then the movable portion (48) is moved to the closed position again and traveled with drive of the first endless chains. Thereafter another clip mechanism (46A) is close to the sucker (44) being at the second position and a movable portion (48) of the clip mechanism (46A) is moved to the open position by the movement of the cam follower (50) within the cam groove (52) so as to perform the next sheet clipping operation.

Figure 8:
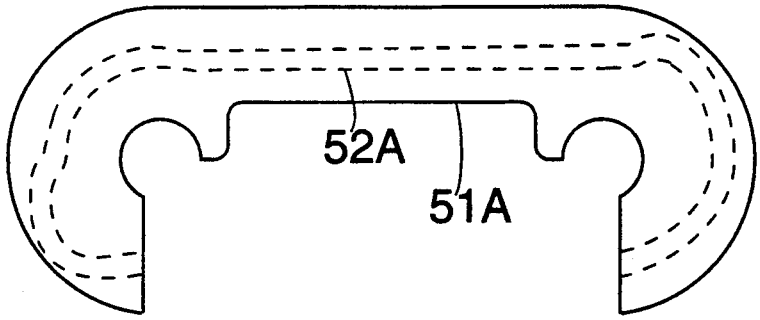
FIG. 8 is a plan view of a cam employed in the second clip mechanism shown in FIG. 5.

In FIG. 5, the second clip mechanisms (22), (22A) associated with the second row of sheet loading stations performs the same sheet feeding operation as the first clip mechanisms (21), (21A) shown in FIG. 4. However, as shown in FIG. 8, a cam groove (52A) of a cam (51A) is a little different from the cam groove (52) of the cam (51) because the second clip mechanisms (22), (22A) draw out sheets from the second row of sheet loading stations which is arranged behind the first row of sheet loading stations.

Thus the above-mentioned sheet feeding operation of the sheet feeding mechanism is repeated.

Referring to FIG. 1 again, the numeral (20) generally indicates a mechanism for transferring sheets received at the sheet receiving stations on the sheet receiving and transferring line (28) to the respective next sheet receiving stations on the sheet receiving and transferring line (28) in order to receive sheets fed from another row of sheet loading stations according to a predetermined collation sequence. The mechanism (29) comprises a pair of chain wheels (31), (31) attached to the machine frame (20), each of the chain wheel pair being disposed at the ends of the base plate (56) of the sheet receiving and transferring line (28), a set of bevel gears (30) for transmitting the rotation of the first chain wheel (25) to one of the second chain wheels (31), an second endless chain (32) extending between a pair of chain wheels (31) in parallel with the sheet receiving and transferring line (28), and a plurality of arms (33) attached to the second endless chain (32) at appropriate spaces. The respective arms (33) are arranged in such a manner that they project toward the base plate (56) through the clearance between the base plate (56) and the guide plate (55). The arms (33) are all transversely moved by the rotation of the chain (32) along the sheet receiving and transferring line (28).

The movement of the arms (33) is synchronized with the sheet feeding operation in such a manner that each arm pushes the side of each sheet set received at the sheet receiving stations on the sheet receiving and transferring line (28) from the respective next sheet receiving stations on the sheet receiving and transferring line (28) after each sheet feeding operation.

Thus at the beginning the sheet feeding operation of the first clip mechanisms is performed and sheets are simultaneously fed from every sheet loading station of the first row. At this time a sheet is fed from the first sheet loading station (A1) of the first row to a first sheet receiving station on the sheet receiving and transferring line (28). Then the sheet is transferred by the associated arm (33) from the first sheet receiving station to a second sheet receiving station on the sheet receiving and transferring line (28) synchronously with the sheet feeding operation of the second clip mechanisms, so that a sheet fed from the first sheet loading station (B1) of the second row is overlapped with the sheet positioned at the second sheet receiving station. Further the sheet set is transferred by the associated arm (33) from the second sheet receiving station to a third sheet receiving station synchronously with the following sheet feeding operation of the first clip mechanisms, so that a sheet fed from the first sheet loading station (A1) of the first row to the first sheet receiving station and a sheet fed from the second sheet loading station (A2) of the first row is overlapped with the sheet set positioned at the third sheet receiving station.

FIG. 1 illustrates the situation in which sheet sets (34) are positioned at the second, fourth, sixth and eighth sheet receiving stations on the sheet receiving and transferring line (28) and FIG. 2 illustrates the situation in which sheet sets (34) are positioned at the first, third, fifth, seventh and nineth sheet receiving stations on the sheet receiving and transferring line (28).

Such operation is repeated and finally, a complete set of sheets is collated in the eighth sheet receiving station on the sheet receiving and transferring line (28). The completed sheet set (35) is moved by the associated arm (33) from the eighth sheet receiving station to the station shown as the rightest side station in FIG. 2, where it is took out from the sheet receiving and transferring line (28).

Figure 3:
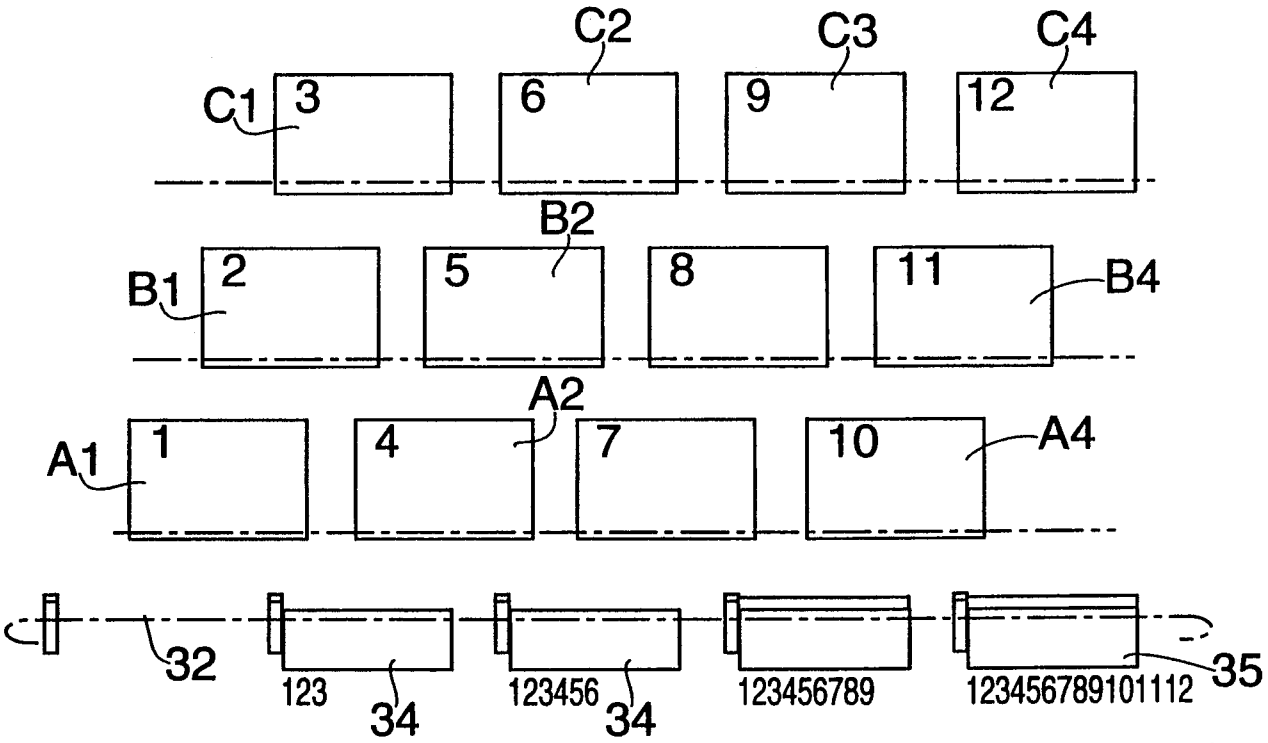
FIG. 3 is a plan view showing an arrangement of sheet loading shelves in another embodiment of a collator in accordance with the present invention.

Although the embodiment provided with two rows of sheet loading stations has been explained, more than two rows can be arranged in the collator. FIG. 3 shows another embodiment provided with three rows of sheet loading stations. In FIG. 3, the symbols (C1)–(C4) designate sheet loading stations composing a third row and the number assigned to each sheet loading station corresponds to the collation sequence and the numbers appearing underside of each set of sheets (34) correspond to the collation sequence.

According to the present invention, even in case a number of pages should be collated, the reduction of the transverse dimension of the collator is achieved so as to economize space for installing the collator.

While the preferred embodiments of the present invention have been shown and described, it is to be understood these disclosures are for the purpose of illustration and that various changes and modifications may be made without departing from the scope of the invention as set forth in the appended claims.

We claim:

1. A collator comprising:

a plurality of rows of sheet loading stations for receiving a supply of sheets to be collated, said plurality of rows of sheet loading stations being arranged in parallel arrangement with respect to one another;

a sheet receiving and transferring line having a plurality of sheet receiving stations aligned for receiving sheets from said sheet loading stations, said sheet receiving and transferring line being arranged in parallel arrangement with each of said row of sheet loading stations;

sheet feeding means providing for repeatedly feeding sheets together from each said row of sheet loading stations to said plurality of sheet receiving stations on said sheet receiving and transferring line, said sheet feeding means comprising a pair of shafts, one of said shafts disposed under an outermost row of sheet loading stations in parallel therewith, the other of said shafts disposed immediately in front of said sheet receiving and transferring line in parallel therewith, each of said shafts being provided with a first chain wheel at one of its ends; a pair of first endless chains extending between said pair of shafts through said first chain wheels; a motor for driving one of said shaft pairs through a drive belt; a plurality of connecting members extending between said pair of first endless chains, said plurality of connecting members being arranged at appropriate spaces; a plurality of clip means connected to each of said connecting members for picking out sheets together from the corresponding row of sheet loading stations so as to deliver the sheets to said sheet receiving stations on said sheet receiving and transferring line; sheet delivering means arranged for said each sheet loading station, said sheet delivering means being provided for delivering sheets one by one from said sheet loading station to said clip means;

means for transferring sheets received at said sheet receiving stations on said sheet receiving and transferring line to the respective next sheet receiving station on said sheet receiving and transferring line in order to receive sheets fed from another row of sheet loading stations according to a predetermined collation sequence;

means for operatively interconnecting the sheet feeding operation of said sheet feeding means with the sheet transferring operation of said means for transferring sheets received at said sheet receiving stations on said sheet receiving and transferring line to the respective next sheet receiving stations on said sheet receiving and transferring line.

2. The collator of claim 1, wherein said each clip means comprises:

a fixed portion supported by said connecting member;

a movable portion pivotably supported on a shaft fixed to said connecting member, said movable portion being provided with a cam follower;

a spring for urging the tip of said movable portion toward said fixed portion;

a cam provided with a cam groove, said cam follower of said movable portion being guided within said cam groove, whereby said movable portion is movable between an open position whereat its tip is away from said fixed portion against the urging force of said spring and a closed position whereat its tip is pushed toward said fixed portion by the urging force of said spring.

3. The collator of claim 2, wherein said plurality of sheet receiving stations are continuously arranged on said sheet receiving and transferring line and said means for transferring sheets received at said sheet receiving stations on said sheet receiving and transferring line to the respective next sheet receiving station on said sheet receiving and transferring line comprises:

a pair of second chain wheels disposed at both ends of said sheet receiving and transferring line;

a second endless chain extending between said pair of second chain wheels, said second endless chain being arranged in parallel with said sheet receiving and transferring line;

a plurality of arms attached to said second endless chain at predetermined spaces and projecting toward said sheet receiving and transferring line so as to move sheets received at sheet receiving stations on said sheet receiving and transferring line to the respective next sheet receiving stations on said sheet receiving and transferring line through circulation of said second endless chain.

4. A collator of claim 3, wherein said means for operatively interconnecting the sheet feeding operation of said sheet feeding means with the sheet transfering operation of said means for transfering sheets received at said sheet receiving stations on said sheet receiving and transfering line to the respective next sheet receiving stations on said sheet receiving and transfering line comprises a set of bevel gears for transmitting the rotation of said first chain wheel driving said first endless chains to one of said second chain wheels of said second endless chain.

* * * * *